US006323450B1

(12) United States Patent
Chen

(10) Patent No.: US 6,323,450 B1
(45) Date of Patent: Nov. 27, 2001

(54) SWITCH ASSEMBLY

(75) Inventor: Chun-Hsu Chen, Pan-Chiao (TW)

(73) Assignee: Tsung-Mou Yu, Taipei (TW)

( * ) Notice: Subject to any disclaimer, the term of this patent is extended or adjusted under 35 U.S.C. 154(b) by 0 days.

(21) Appl. No.: 09/627,974

(22) Filed: Jul. 28, 2000

(51) Int. Cl.[7] ..... H01H 21/00
(52) U.S. Cl. ..... 200/553; 337/66
(58) Field of Search ..... 200/401, 438, 200/439, 339, 408, 409, 553, 557, 6 R

(56) References Cited

U.S. PATENT DOCUMENTS 4,167,720 * 9/1979 Krasser ..... 337/60
4,937,548 * 6/1990 Sdunek ..... 337/70
5,223,813 * 6/1993 Cambreleng et al. ..... 337/66
5,451,729 * 9/1995 Onderka et al. ..... 200/18
5,558,211 * 9/1996 Heydner et al. ..... 200/553

* cited by examiner

*Primary Examiner*—Paula Bradley
*Assistant Examiner*—Nhung Nguyen

(57) ABSTRACT

A switch assembly, an ON/OFF control mechanism for power supply, mainly comprises a switch knob, a contact control member, and a resilient contact piece, wherein the switch knob is to be depressed to drive a protuberance to directly oppress or release the contact control member so as to in turn oppress or release the resilient contact piece for effecting or cutting off a power supply. By using a simple structure like this, easy assembling, low cost, simplification of interactive process, and low breakdown ratio are made possible.

4 Claims, 9 Drawing Sheets

SWITCH ASSEMBLY

BACKGROUND OF THE INVENTION

1. Field of the Invention

This invention relates generally to a switch assembly, and more particularly, to a switch assembly, which is implemented for ON/OFF control by taking advantage of a protuberance of a switch knob that directly depresses or releases a contact control member to thereby oppress or release a resilient contact piece to effect or cut off the power supply.

2. Description of the Prior Art

Power switch is a widely used electronic component for ON/OFF control of a power supply, and is highlighted in its structural complexity in consideration of cost, or furthermore, in its reliability of security.

For improvement of a switch assembly, many patents, such as U.S. Pat. Nos. 4,167,720, 4,937,548, 5,223,813, 5,451,729, 5,558,211, etc., have been disclosed, wherein a common defect is known as excessive elements being used down from a switch knob that results in a complicated interactive process with high breakdown ratio and fabrication cost.

For example, in the U.S. Pat. No. 5,223,813 shown in FIGS. 1, 2, 3, after a switch knob has been depressed, a link rod under the switch knob is driven to drive a sway component to oppress or release a resilient contact piece thereunder to enable an upper contact dot to depart from or contact with a lower contact dot to thereby effect or cut off a power supply. It can be operated all right under normal conditions, however, in consideration of cost, productivity, and blunt response, there are still rooms for further improvements.

SUMMARY OF THE INVENTION

The primary object of this invention is to provide a switch assembly for improvement of assembling work, production cost, response time, and breakdown ratio.

Another object of this invention is to pair a thermal-sensitive element with a tact control member so as to ensure security in case of overload or overheat.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
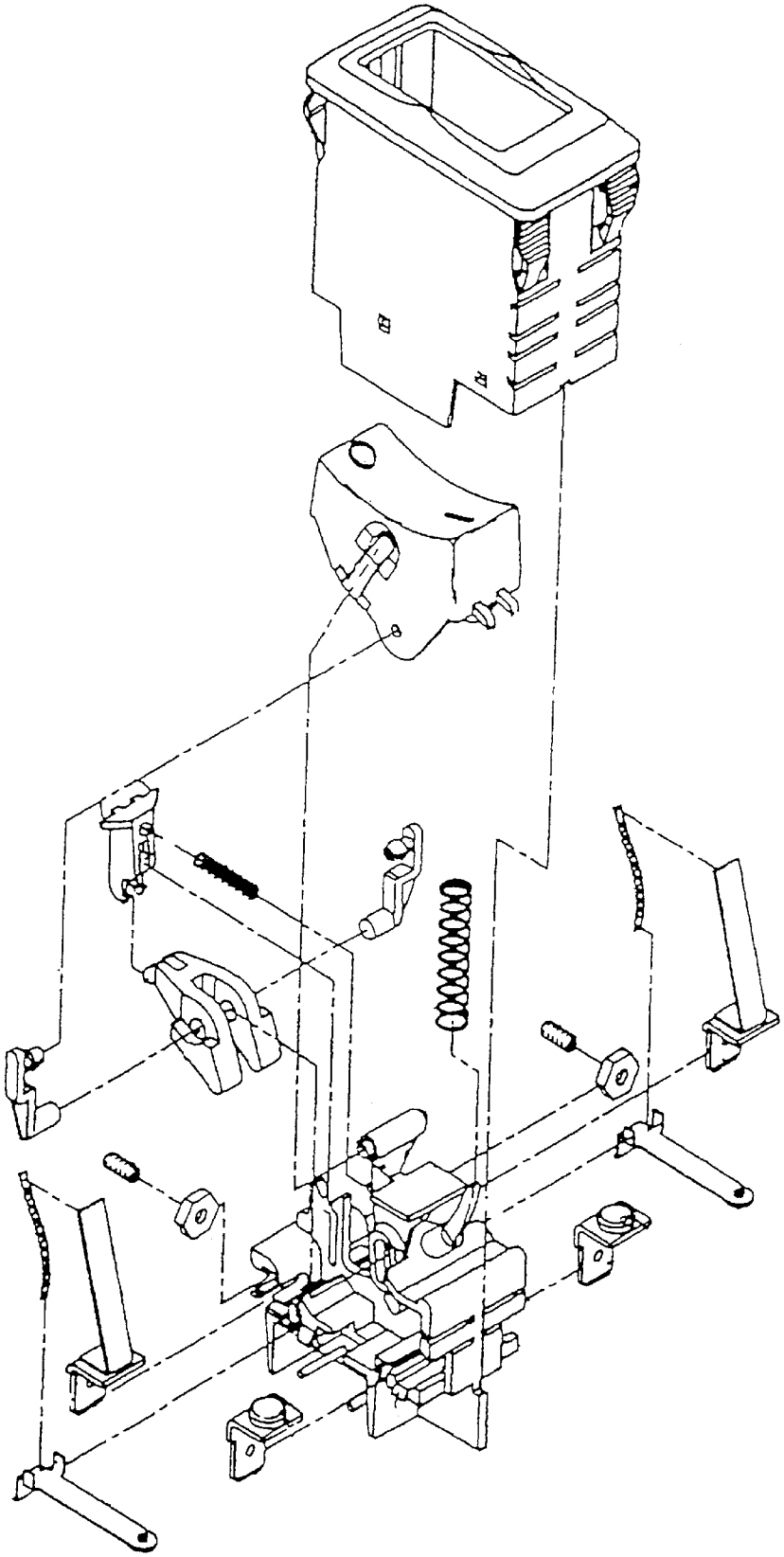
FIG. 1(PRIOR ART)
FIG. 1 is an exploded view of a prior art in three dimensions.
Figure 2:
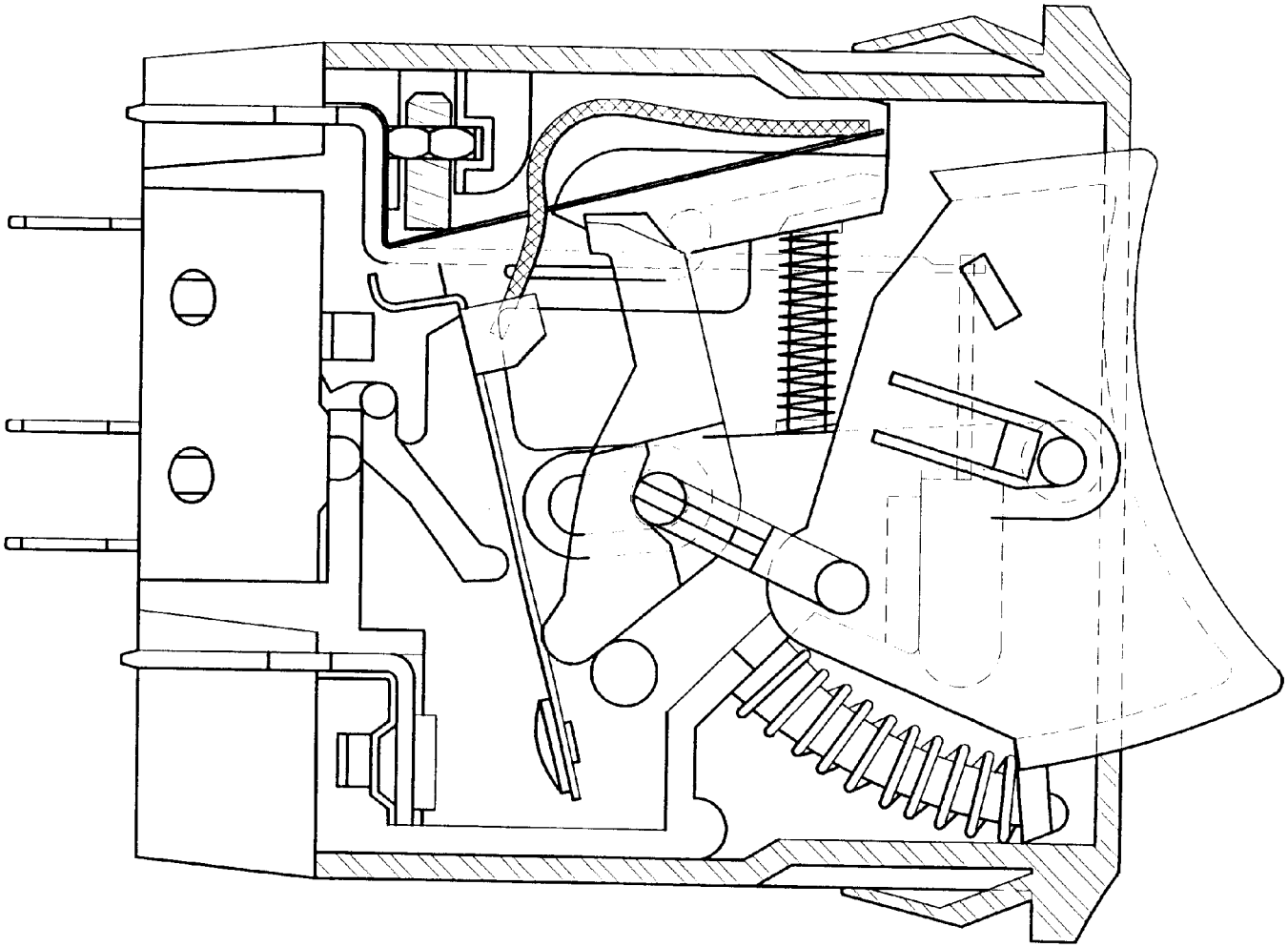
FIG. 2(PRIOR ART)
FIG. 2 is a cutaway sectional view showing the prior art under OPEN (OFF) state.
Figure 3:
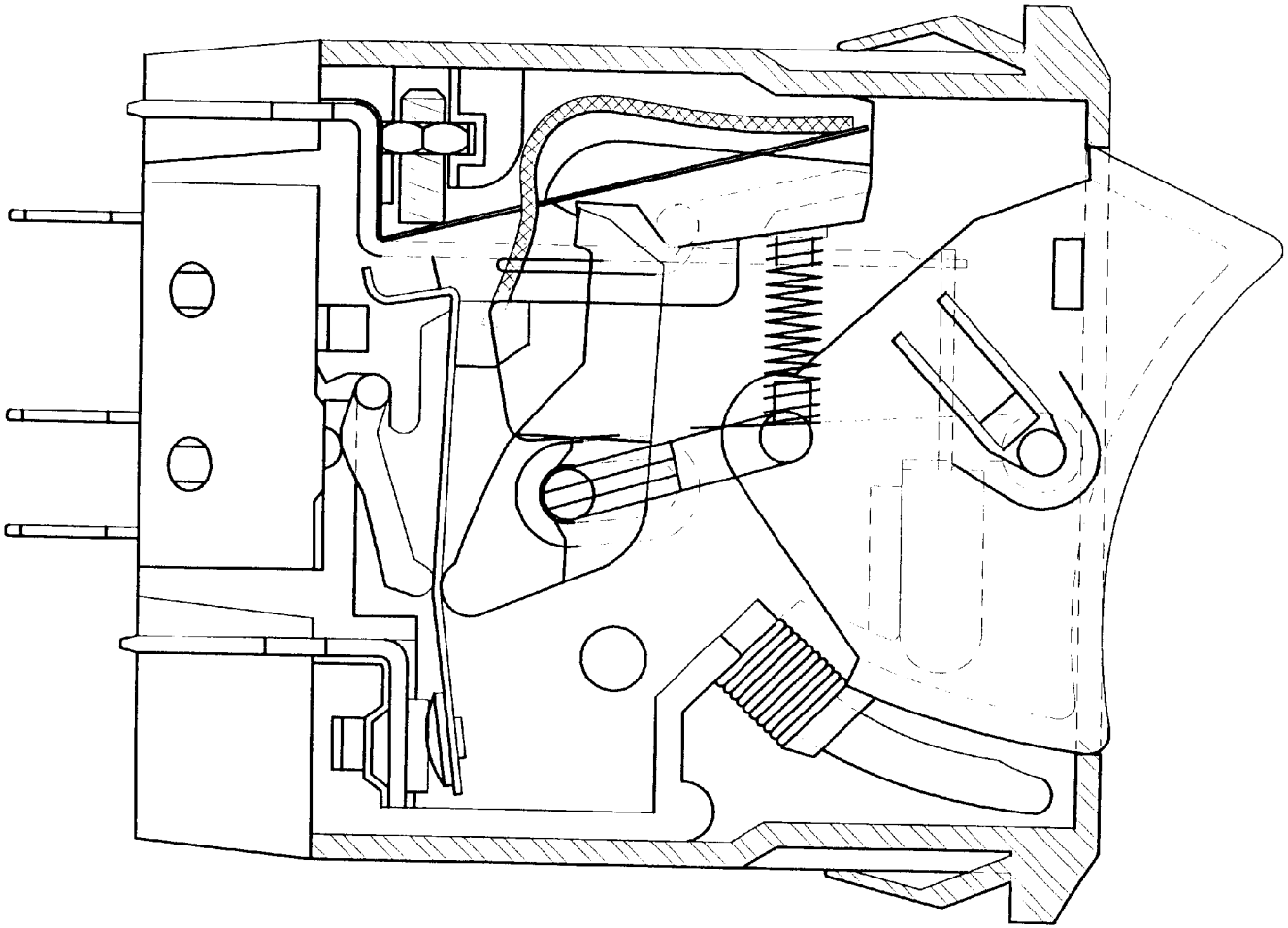
FIG. 3(PRIOR ART)
FIG. 3 is a cutaway sectional view showing the prior art under CLOSE (ON) state.
Figure 4:
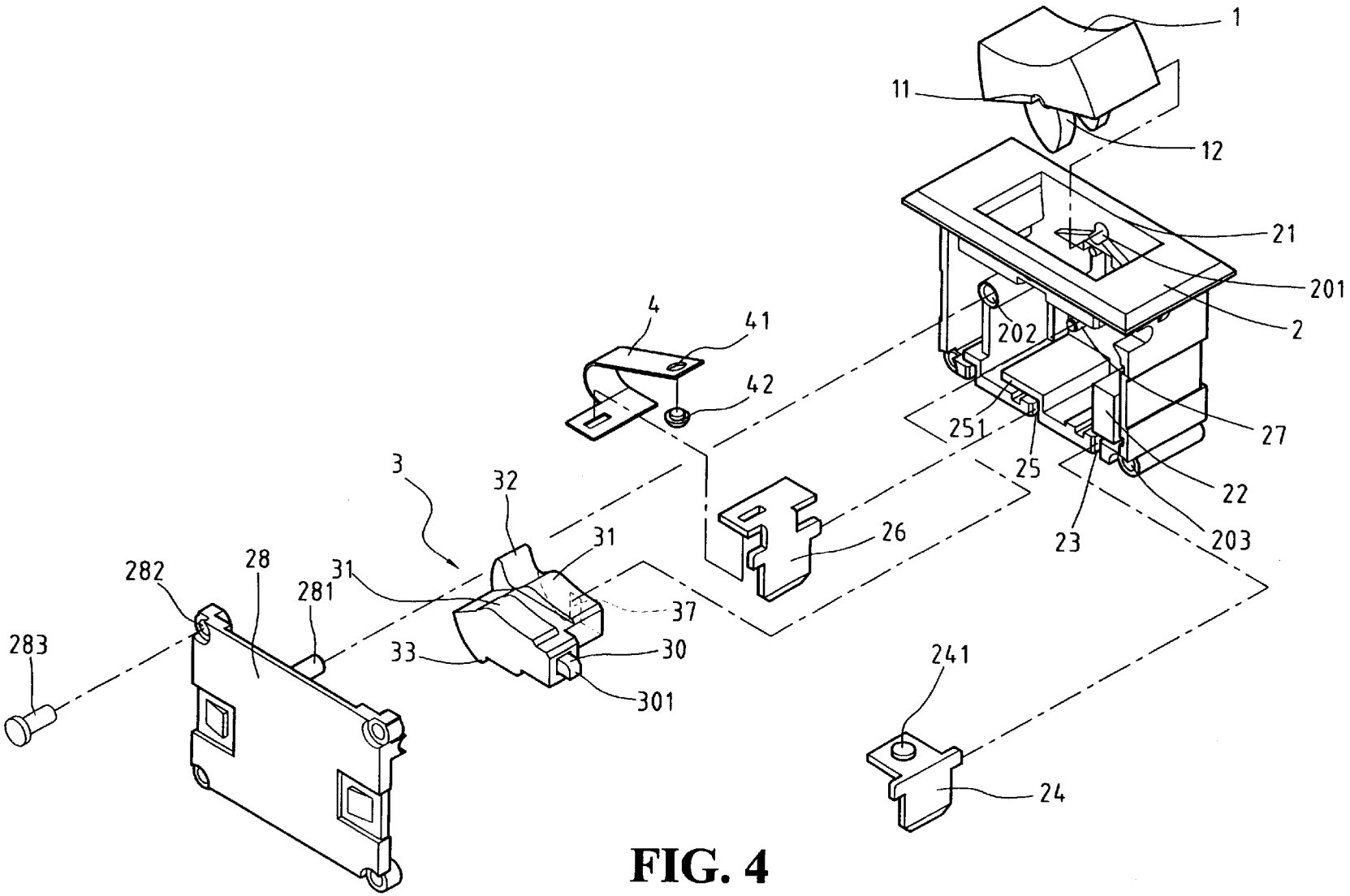
FIG. 4 is an exploded view of an embodiment (1) of this invention in three dimensions.

A switch assembly of this invention illustrated in FIG. 4 mainly comprises a switch knob 1, a casing 2, a contact control member 3, and a resilient contact piece 4.

In the switch knob 1, a dipped arcuate face is formed on a top end, also, an axle-supporting groove 11 is concavely and centrally disposed at a bottom end to enable the switch knob 1 to rotate surrounding the axle-supporting groove 11, and the bottom end of the switch knob 1 is extended downwardly to form at least a protuberance 12, which, in this case, is substantially a triangular protrusion.

The casing 2 is a hollow housing having an open lateral wall, wherein an opening 21 is formed at a top end of the casing 2; an axle-supporting rod 201 is protrusively resided on an inner wall under the opening 21 for assembling and disposing the switch knob 1 in the axle-supporting groove 11; a first and a second slot 23, 25 are arranged in a bottom end of the casing 2 for plugging a first and a second terminal 24, 26 respectively; a hollow combining column 202, a stopper 22, and a stationary supporting pin 27 are protrusively fitted on the inner wall, and a plurality of combining holes 203 are distributed to corners of the inner wall. Moreover, a cover 28 is provided to the casing 2, wherein an assembling post 281 in a position corresponding to the hollow combining column 202 is protuberantly disposed on an inner wall of the cover 28, and a plurality of combining holes 282 in positions corresponding to the combining holes 203 of the casing 2 are distributed to corners of the cover 28; and the cover 28 is riveted to joint with the casing 2 with a plurality of rivets 283.

In the contact control member 3, it is found: at least an upper lump 31 located on a top end of contact control member 3; the top end being extended to form a hook portion 32; at least a lower lump 33 formed at a bottom end of the contact control member 3 in a position substantially corresponding to the upper lump 31; and the contact control member 3 being extended to form a tail end 30 with a propping end 301. Furthermore, an upright longitudinal slot 37 is trenched in a lateral face inside the contact control member 3 for assembling and jointing the contact control member 3 to the stationary supporting pin 27 of the casing 2 so that the contact control member 3 is movable up and down along the stationary supporting pin 27.

The resilient piece 4 is provided with a contact hole 41 at its upper free end for combining with an upper contact dot 42 which is located right above a lower contact dot 241 of the first terminal 24, and the lower end of the contact piece 4 is a flat sheet coupled with an upper end of the second terminal 26, and is fixedly clamped between a fixing plate 251 and a sole plate of the casing 2.

Figure 5:
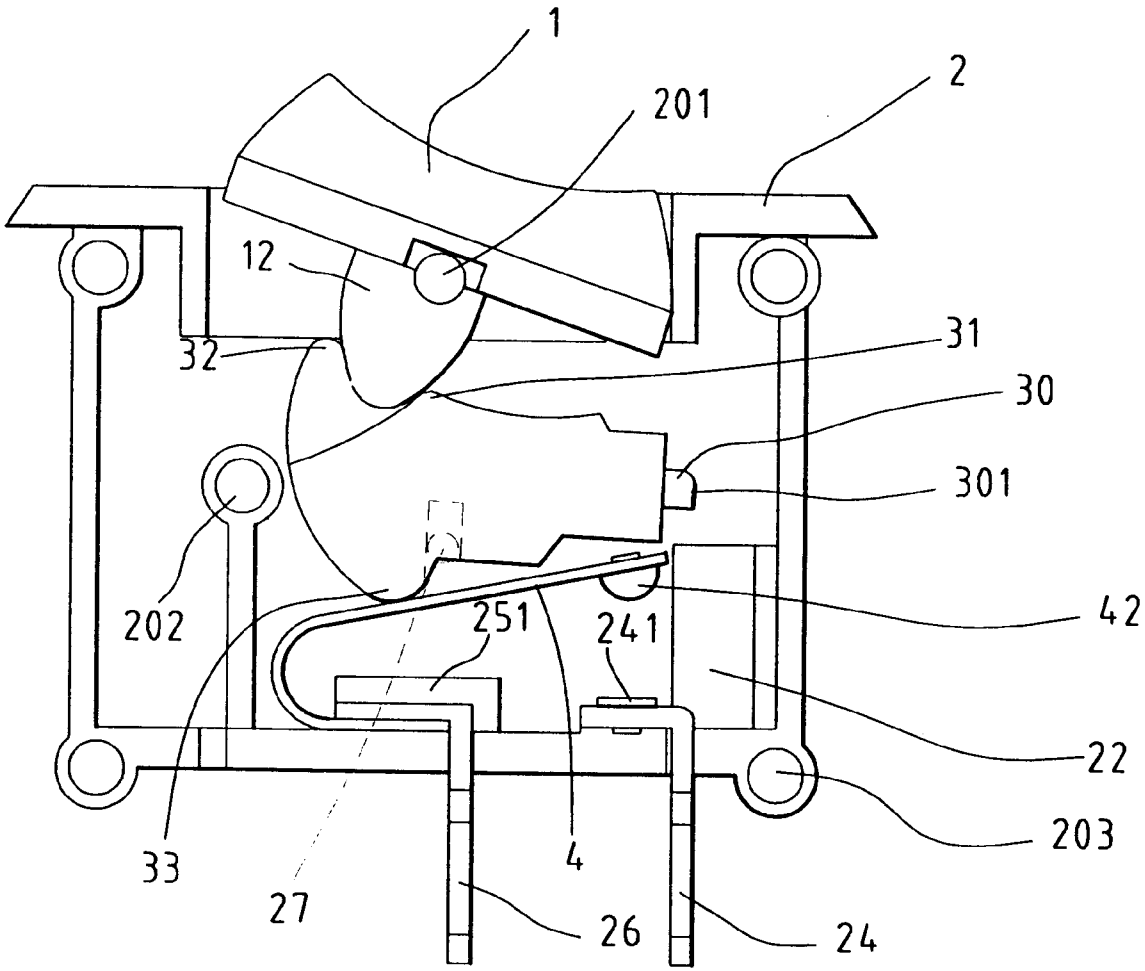
FIG. 5 is an assembled cutaway sectional view showing the embodiment (1) of this invention under OPEN (OFF) state.

As shown in FIG. 5, an assembled cutaway sectional view of an embodiment (1) of this invention under OPEN (OFF) state controlled by a user, when the user depresses the right end of the switch knob 1, the switch knob 1 is forced to rotate clockwise surrounding the axle-supporting rod 201 which is taken as a pivot. Simultaneously, taking the axle-supporting rod 201 as a pivot, the protuberance 12 rotates clockwise in an arcuate movement (leftward in this case), and the bottom end of the protuberance 12 slides from the right side of the upper lump 31 of the contact control member 3 to the left side of the upper lump 31 so that the resilient contact piece 4 is freed from constraint of the lower lump 33 of the contact control member 3 to bounce upwardly and allow the upper contact dot 42 to depart from the lower contact dot 241 so as to separate the first terminal 24 from the second terminal 26 and cut off the power supply accordingly.

Figure 6:
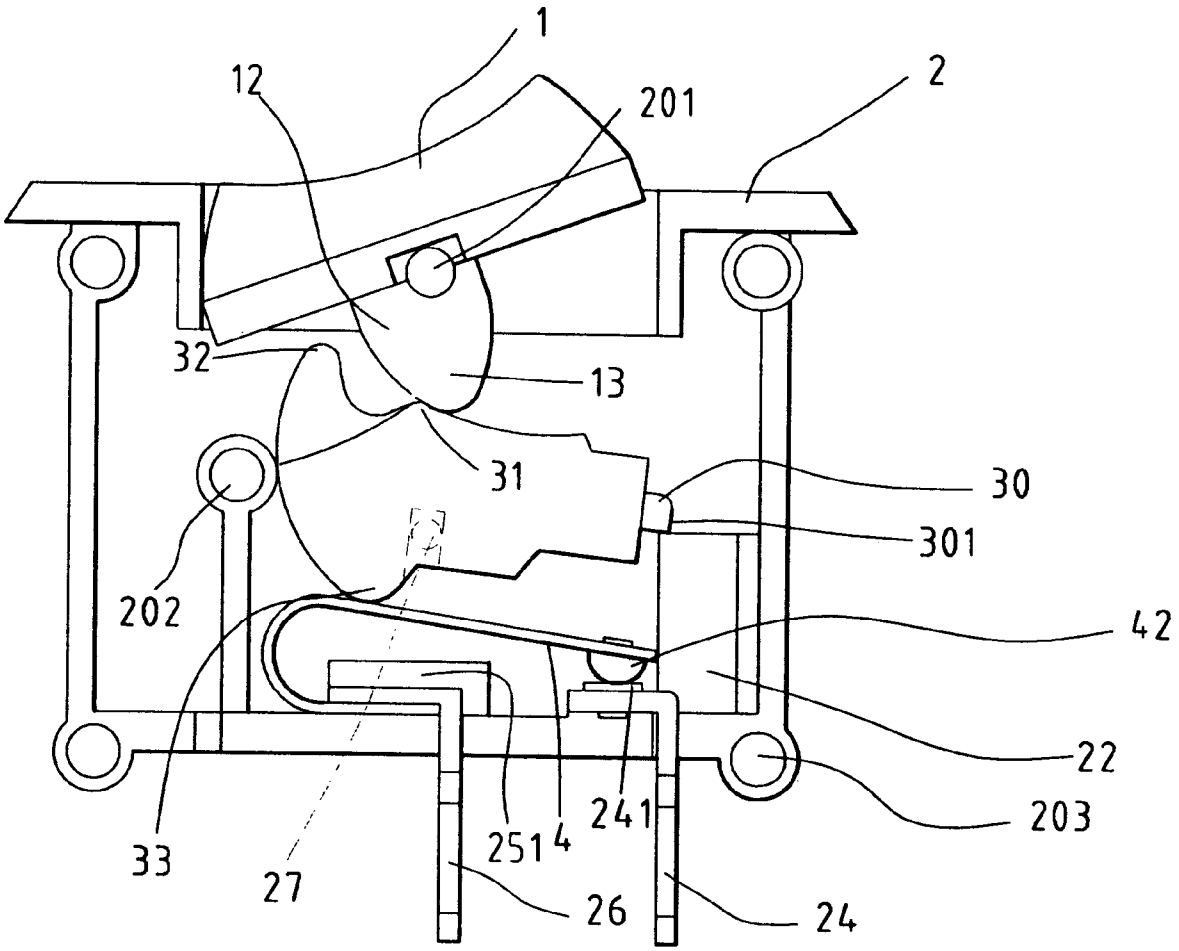
FIG. 6 is an assembled cutaway sectional view showing the embodiment (1) of this invention under CLOSE (ON) state.

As illustrated in FIG. 6, an assembled cutaway sectional view of the embodiment (1) of this invention under CLOSE (ON) state, when a user depresses the left end of the switch knob 1, the switch knob 1 is forced to rotate counterclockwise and so is the protuberance 12 for arcuate movement (rightward in this case) by taking the axle-supporting rod 201 as a pivot. Simultaneously, the bottom end of the protuberance 12 slides from the left side of the upper lump 31 of the contact control member 3 to the right side to depress the contact control member 3 downwardly to have the lower lump 33 constrain the resilient contact piece 4 so that the upper contact dot 42 at the bottom face of the free end of the resilient contact piece 4 will contact the lower contact dot 241 to thereby build a ready route for the power supply to go through the first terminal 24, the lower contact dot 241, the upper contact dot 42, the resilient contact piece 4, and the second terminal 26.

Moreover, under OPEN (OFF) state of the switch, the propping end 301 at the tail end 30 of the contact control member 3 is located exactly over the top face of the stopper 22 of the casing 2, on the contrary, the propping end 301 will prop against the top face of the stopper 22 under CLOSE (ON) state and serve as a pivot center for rotation of the contact control member 3 so that the lower lump 33 will rotate counterclockwise to depress the resilient contact piece 4 and enable the upper contact dot 42 to contact the lower contact dot 241.

Using such a simple structure, a power supply route can be effected or voided by depressing the switch knob 1 to have the protuberance 12 push or release the interacted contact control member 3 to in turn oppress or release the resilient contact piece 4.

Figure 7:
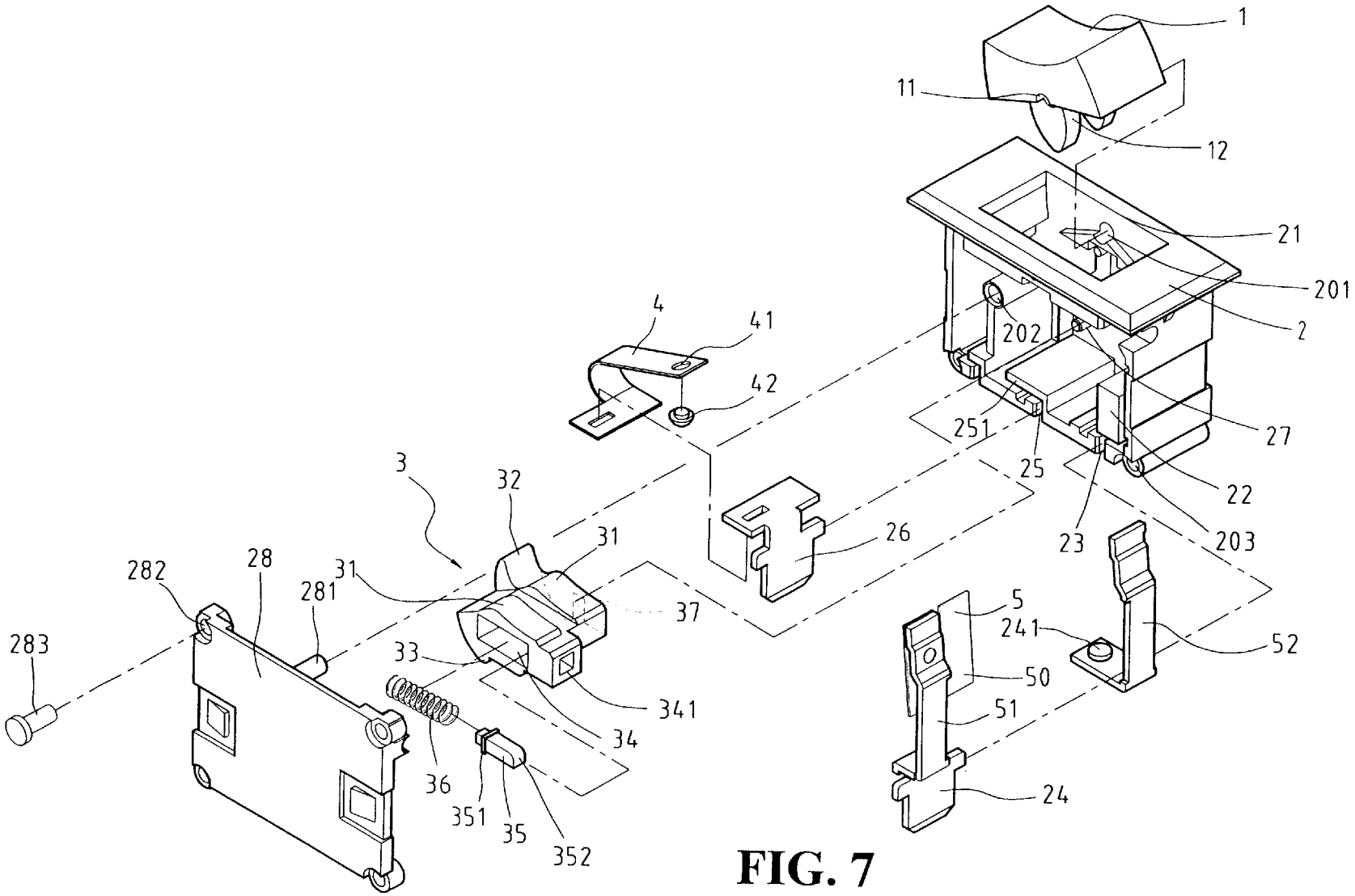
FIG. 7 is an exploded view of another embodiment (2) of this invention in three dimensions.
Figure 8:
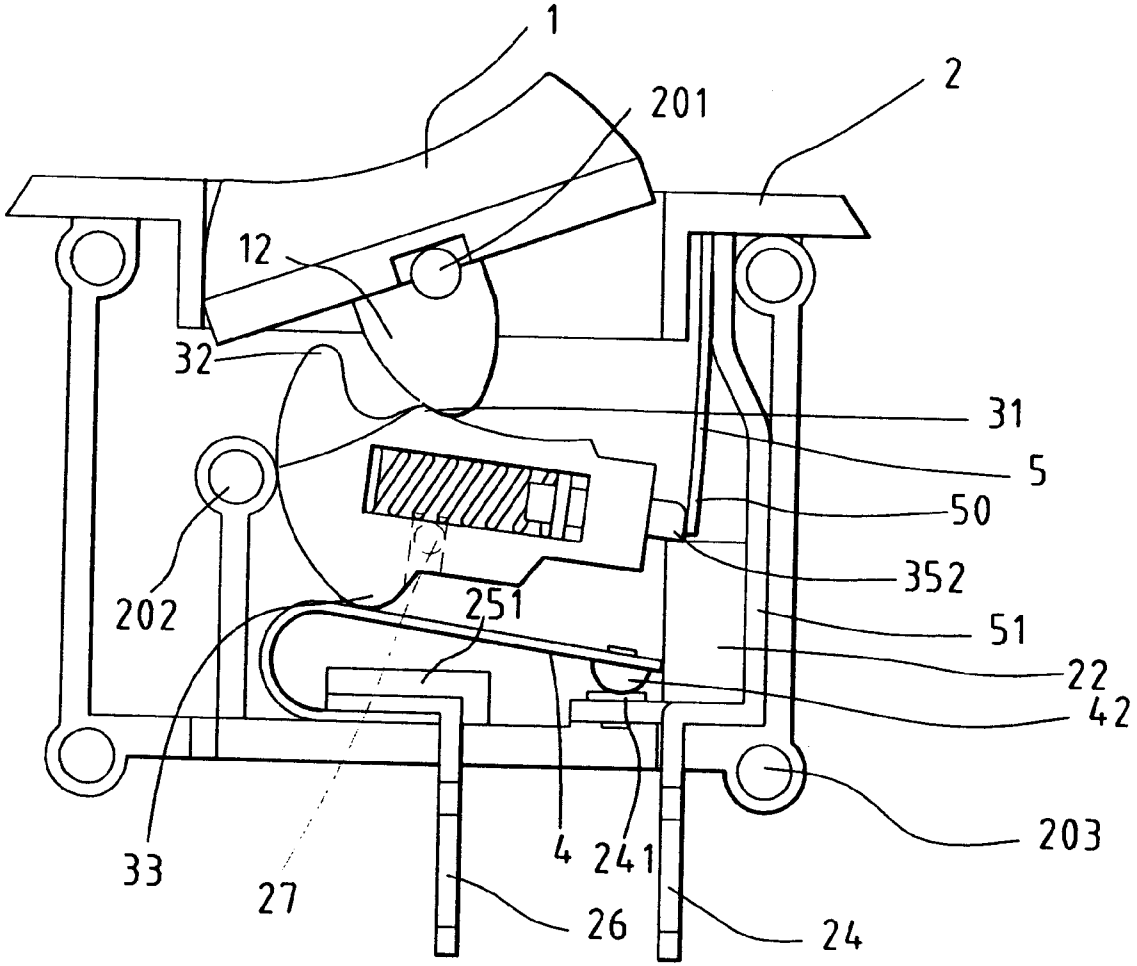
FIG. 8 is a cutaway sectional view of the embodiment (2) showing another structure of a contact control member of this invention under CLOSE (ON) state.

In another embodiment (2) of this invention illustrated in FIGS. 7, 8, an assembling slot 34 is recessively disposed in a lateral face of the contact control member 3, wherein a slot opening 341 is formed in a tail end of the assembling slot 34; a movable tail end 35 with the same function as the tail end 30 in embodiment (1) is assembled in the assembling slot 34; a flange 351 is formed enclosing a nearer end of the column body of the movable tail end 35, the farther end of the movable tail end 35 is a propping end 352, and the cross-sectional area of the movable tail end 35 is slightly smaller than that of the slot opening 341; and a resilient member 36 (a compressible spring in this case) is disposed in the assembling slot 34 so that the movable tail end 35 can be stretched or compressed relatively in the assembling slot 34 and limited by the flange 351.

Figure 9:
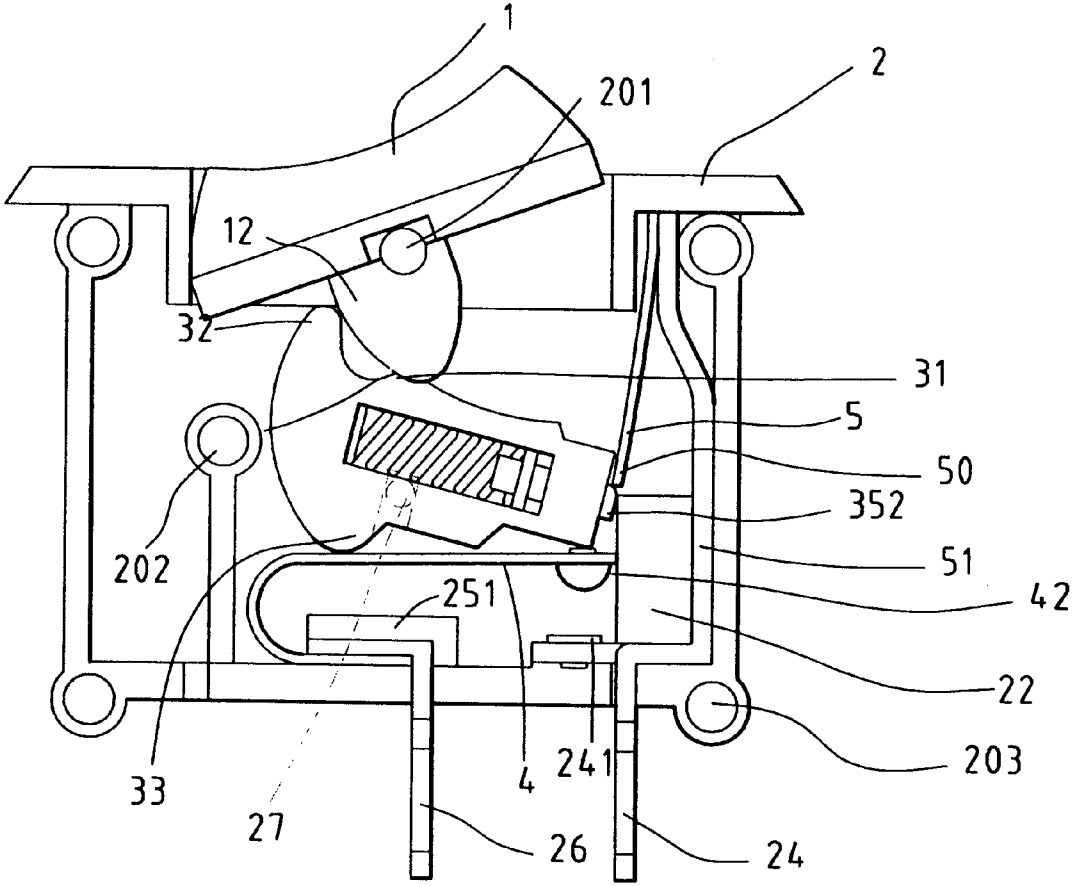
FIG. 9 is a cutaway sectional view showing a cutoff action of the embodiment (2) of this invention in case of overload or overheat.

By taking advantage of assembling a paired metallic alloy strip 5 (thermal-sensitive element) to the movable tail end 35, the alloy strip 5 will prop against the propping end 352 of the movable tail end 35 in case of overload or overheat (shown in FIG. 9) such that the movable tail end 35 will retreat back toward the casing of the contact control member 3, and accordingly, the propping end 352 is interacted to depart from the top face of the stopper 22. Thus, the lower lump 33 will rotate clockwise surrounding the stationary pillar 27 in the longitudinal slot 37 to have the resilient contact piece 4 set free from constraint and bounced upwardly to drive the upper contact dot 42 to escape from the lower contact dot 241 and thereby cut off the power supply to ensure security.

Although, this invention has been described in terms of preferred embodiments, it is apparent that numerous variations and modifications may be made without departing from the true spirit and scope thereof, as set forth in the following claims.

What is claimed is:

1. A switch assembly comprising:

a casing having a top opening and an inner wall formed with at least an axle supporting rod;

a switch knob having a bottom end formed with at least an axle supporting groove, and a protuberance extended downwardly from said bottom end, said switch knob being received through said top opening by said casing with said axle supporting groove supporting said axle supporting rod;

a contact control member having a top end formed with a hook portion and at least an upper lump, a bottom end formed with at least a lower lump, a lateral side formed with a recessive assembling slot with a slot opening at a tail end of said contact control member, a resilient member disposed in said assembling slot, and a column body coupled to said resilient member and disposed in said slot opening to form a movable tail end supported by a stopper disposed in said casing;

a thermal-sensitive metal strip disposed within said casing, said movable tail end being pushed by said resilient member against said thermal-sensitive metal strip;

a first terminal with a lower contact dot; and a resilient contact piece having a lower portion coupled to a second terminal, and an upper portion having a free end formed with an upper contact dot, said resilient contact piece being disposed below said contact control member;

wherein said switch assembly is operated to an OFF state by depressing a first side of said switch knob to rotate said protuberance clockwise for controlling said contact control member to free and disconnect said upper contact dot from said lower contact dot, to an ON state by depressing a second side of said switch knob to rotate said protuberance counter clockwise for controlling said contact control member to connect said upper contact dot to said lower contact dot, and said thermal-sensitive metal strip is expanded to push said movable tail end off said stopper to disconnect said upper contact dot from said lower contact dot when said switch assembly is overloaded or overheated in an ON state.

2. The switch assembly as claimed in claim 1, further comprising an upright longitudinal slot formed in said contact control member and a stationary supporting pin disposed in said casing, wherein said stationary supporting pin is positioned within said upright longitudinal slot and said contact control member is movably constrained upwards or downwards by said upright longitudinal slot.

3. The switch assembly as claimed in claim 1, wherein said column body has one end formed with a flange for coupling to said resilient member.

4. The switch assembly as claimed in claim 1, wherein said resilient member is a compressible spring.

* * * * *